US011530607B2

(12) United States Patent
Kalb

(10) Patent No.: US 11,530,607 B2
(45) Date of Patent: Dec. 20, 2022

(54) ULTRASONIC INTERVENTIONLESS SYSTEM AND METHOD FOR DETECTING DOWNHOLE ACTIVATION DEVICES

(71) Applicant: Dril-Quip, Inc., Houston, TX (US)

(72) Inventor: Frank D. Kalb, Cypress, TX (US)

(73) Assignee: Dril-Quip, Inc., Houston, TX (US)

( * ) Notice: Subject to any disclaimer, the term of this patent is extended or adjusted under 35 U.S.C. 154(b) by 114 days.

(21) Appl. No.: 17/284,266

(22) PCT Filed: Oct. 7, 2019

(86) PCT No.: PCT/US2019/055012
§ 371 (c)(1),
(2) Date: Apr. 9, 2021

(87) PCT Pub. No.: WO2020/076709
PCT Pub. Date: Apr. 16, 2020

(65) Prior Publication Data

US 2021/0381370 A1 Dec. 9, 2021

Related U.S. Application Data

(60) Provisional application No. 62/743,714, filed on Oct. 10, 2018.

(51) Int. Cl.
*E21B 47/18* (2012.01)
*E21B 49/08* (2006.01)
*E21B 47/002* (2012.01)

(52) U.S. Cl.
CPC ..... *E21B 47/18* (2013.01); *E21B 47/0025* (2020.05); *E21B 49/0875* (2020.05)

(58) Field of Classification Search
CPC ..... E21B 47/18; E21B 23/00; E21B 43/11; E21B 47/09; E21B 47/0025; G01V 3/00
See application file for complete search history.

(56) References Cited

U.S. PATENT DOCUMENTS 7,274,989 B2 * 9/2007 Hopper ..... E21B 47/00 702/6
7,665,543 B2 * 2/2010 Bostick, III ..... E21B 34/101 340/856.4
9,303,476 B2 * 4/2016 Wilson ..... E21B 34/102
10,246,965 B2 * 4/2019 Turley ..... E21B 23/08
(Continued)

OTHER PUBLICATIONS

International Search Report and Written Opinion issued in related PCT Application No. PCT/US2019/055012 dated Feb. 5, 2020, 12 pages.

*Primary Examiner* — Albert K Wong
(74) *Attorney, Agent, or Firm* — Baker Botts L.L.P.

(57) ABSTRACT

An interventionless system and method: of detecting a downhole activation device are provided. The system includes a first detector disposed downhole in a fluid pathway and; a second detector disposed downhole of the first detector in the fluid pathway. In one exemplary embodiment, the detectors include a pair of ultrasonic transducers that generate signals indicative of fluid pathway flow. Differences in the signals between the detectors are indicative of the presence of the downhole activation device within the fluid pathway. The system also includes a deployment port disposed above the second detector from which the downhole activation device may be deployed into the fluid pathway.

20 Claims, 6 Drawing Sheets

(56) References Cited

U.S. PATENT DOCUMENTS

| | | | | |
|---|---|---|---|---|
| 10,323,505 | B2 * | 6/2019 | Kyle | E21B 47/053 |
| 10,597,960 | B2 * | 3/2020 | Solem | E21B 23/00 |
| 10,598,002 | B2 * | 3/2020 | Sites | E21B 47/09 |
| 10,760,382 | B2 * | 9/2020 | Mau | E21B 23/01 |
| 10,760,413 | B2 * | 9/2020 | Wilson | G01V 3/38 |
| 11,280,166 | B2 * | 3/2022 | Phelps | H05K 1/11 |
| 11,384,626 | B2 * | 7/2022 | Archibald | E21B 43/1185 |
| 2010/0018714 | A1 * | 1/2010 | Merlau | E21B 47/18 166/374 |
| 2013/0043873 | A1 | 2/2013 | Brannon et al. | |
| 2013/0153212 | A1 * | 6/2013 | Myers | E21B 40/00 166/250.01 |
| 2014/0008083 | A1 | 1/2014 | Ring et al. | |
| 2014/0076542 | A1 | 3/2014 | Whitsitt et al. | |
| 2015/0361761 | A1 | 12/2015 | Lafferty et al. | |
| 2020/0102803 | A1 * | 4/2020 | Ruppert | E21B 33/068 |

* cited by examiner

ULTRASONIC INTERVENTIONLESS SYSTEM AND METHOD FOR DETECTING DOWNHOLE ACTIVATION DEVICES

CROSS-REFERENCE TO RELATED APPLICATIONS

The present application is a U.S. National Stage Application of International Application No. PCT/US2019/055012 filed Oct. 7, 2019, which claims priority to U.S. Provisional Application Ser. No. 62/743,714 filed on Oct. 10, 2018 both of which are incorporated herein by reference in their entirety for all purposes.

TECHNICAL FIELD

The present disclosure relates generally to detection of objects launched downhole and, more particularly, to an interventionless system and method for detecting downhole activation devices traveling through a pathway.

BACKGROUND

Downhole systems typically contain a sub-assembly, known as a flag sub, that indicates when an object has been launched or has passed through the sub assembly. A flag sub generally detects objects by way of a mechanical trip within the flow stream that is knocked out of the way by the object. The knocked trip generally actuates an external switch, providing visual confirmation of successful launch and passage of an object through the flag sub.

Flag subs are used to detect objects including setting balls, pump down plugs (PDPs), fracturing plugs, and a number of other downhole activation devices employed during wellsite operations. Flag subs, for example, are commonly employed to detect setting balls during well cementing.

Wellsite operators use downhole activation devices for many purposes. Examples include—but are not limited to—using a downhole activation device as a barrier that separates wellbore fluids or isolates sections of a wellbore. Downhole activation devices may act as a plug, for the purposes of generating hydraulic pressure. They can activate tools downhole or wipe down the wall surface of a wellbore. For example, operators will use setting balls to seal off a section of a wellbore and build hydraulic pressure for the purpose of setting liner hangers. Once the liner is set, the pressure is increased further, dislodging the setting ball and restoring normal circulation downhole.

Because flags subs confirm whether a wellsite operator has successfully launched a downhole activation device, they are currently one of the best indicators that the downhole activation device has arrived at its intended location and will perform its intended purpose. If the flag sub fails to indicate or erroneously signals that a downhole object has been launched, operators risk their safety and the wellsite's survival. The current mechanical trips in flag subs can be inefficient and there are many ways they may fail to indicate the presence of a downhole activation device. They are obstructive to flow and are often damaged. They may cause problems from having to be moved or pushed to create the indication such as generating false positive and false negative indications. Mechanical trips also generally require manual reset before they can indicate release of the next downhole activation device.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
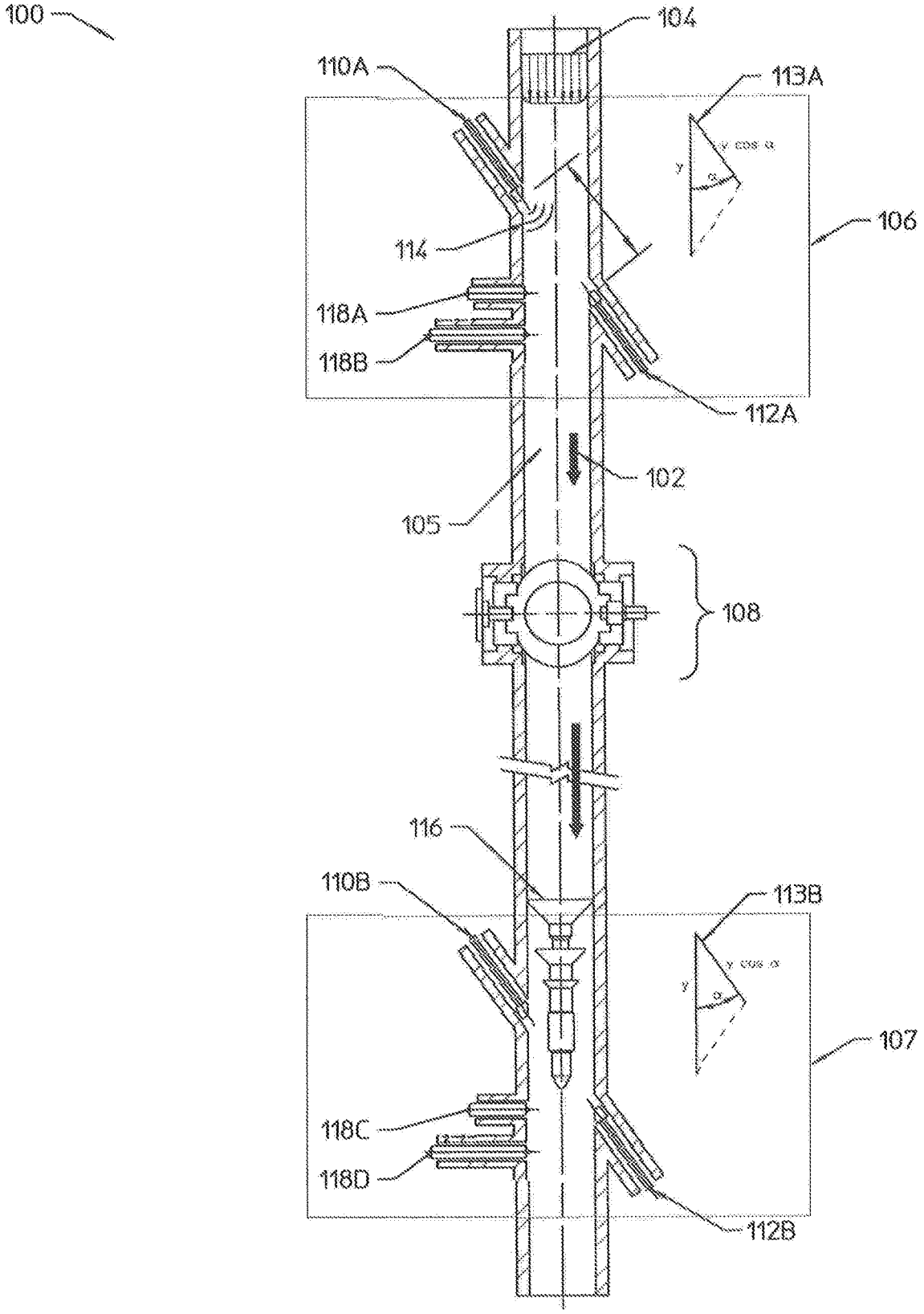
FIG. 1 is a cutaway view of the interventionless detection system having two ultrasonic flow detectors, one of the detectors being blocked by a downhole activation device in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation-specific decisions must be made to achieve developers' specific goals, such as compliance with system-related and business-related constraints, which will vary from one implementation to another. Moreover, it will be appreciated that such a development effort might be complex and time consuming but would nevertheless be a routine undertaking for those of ordinary skill in the art having the benefit of the present disclosure. In no way should the following examples be read to limit, or define, the scope of the disclosure.

For purposes of this disclosure, a controller may include any instrumentality or aggregate of instrumentalities operable to compute, classify, process, transmit, receive, retrieve, originate, switch, store, display, manifest, detect, record, reproduce, handle, or utilize any form of information intelligence, or data for business, scientific, control, or other purposes. For example, a controller may be a personal computer, a network storage device, or any other suitable device and may vary in size, shape, performance, functionality, and price. The controller may include random access memory (RAM), one or more processing resources such as a central processing unit (CPU) or hardware or software control logic, ROM, and/or other types of nonvolatile memory. Additional components of the controller may include one or more disk drives, one or more network ports for communication with external devices as well as various input and output (I/O) devices, such as a keyboard, a mouse, and a video display. The controller may also include one or more buses operable to transmit communications between the various hardware components.

The processes described herein may be performed by one or more controllers containing at least a processor and a memory device coupled to the processor containing a set of instructions that, when executed by the processor, cause the processor to perform certain functions such as sending instructions to the deployment port to launch an object downhole and/or sending instructions to one or more detectors to calibrate or transmit signals.

The terms "couple" or "couples" as used herein are intended to mean either an indirect or a direct connection, Thus, if a first device couples to a second device, that connection may be through a direct connection, or through an indirect mechanical, electromagnetic, or electrical connection via other devices and connections. Similarly, the term "communicatively coupled" as used herein is intended to mean either a direct or an indirect communication connection, Such connection may be a wired or wireless connection such as, for example, Ethernet or LAN, Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

Certain embodiments according to the present disclosure may be directed to an interventionless mechanism for detecting the presence of a downhole activation device such as a pump down plug (PDP), a setting ball, or any device used to perform a function downhole in a well or work string. The system employs the use of two detectors, which in one exemplary embodiment may be two ultrasonic flow detectors. The first ultrasonic flow detector, located at the entry to a cement head system, is the baseline reference from which all flow measurements are compared. The second downstream detector is integral to a flag sub whereby it is below the drop sub-assembly so that it is exposed to any dropped components. When a PDP or a similar object is launched, the signals from the first flow detector and the second detector are compared.

In one exemplary embodiment, the first detector establishes the base flow rate through the system. This value also configures into calculating the Trigger Duration Event Gate (TDEG), the instantaneous time it takes an object to flow through the cement head system. Launching an object starts the TDEG and allows the second detector to make flow measurements and compare them with measurements from the first detector.

In one exemplary embodiment, when nothing is passing through the system, the flow measurements from the two detectors should be equal. However, once an object passes the second detector, the object obstructs the transmitted signal to the detector receiver and registers a flow rate that is different from the base flow rate. Due to the conservation of mass and energy of a system, flow into a system must equal the flow out of a system. Thus, the differences in flow rate indicate that the object is obstructing the second detector. Return of the flow measurements to equal means the object has exited the system.

Turning now to the drawings, FIG. 1 shows an interventionless detection system in accordance with one embodiment of the present invention referred to generally by reference numeral 100, it demonstrates unidirectional flow 102 in the form of a fully developed flow profile ψtraveling downstream via a fluid pathway 105. The interventionless detection system 100 may have two ultrasonic flow detectors 106 and 107. The first detector 106 is utilized to detect a baseline flow through the fluid pathway 105. The second detector 107 is intended to be blocked by a downhole activation device in accordance with an embodiment of the present disclosure. The second detector 107 may be located downstream from the first detector 106. The second detector 107 is located downstream from a deployment port 108, where downhole activation devices are released downstream.

Each flow detector may include a transducer pair. In one exemplary embodiment, the first detector 106 comprises two transducers 110A and 112A and the second detector 107 comprises two transducers 110B and 112B. Each transducer is positioned at an inclined angle 113 so it may measure flow through the system by calculating the rate of sound wave propagation 114. For example, in one embodiment, the first detector 106 may consist of an upstream output transducer 110A and a downstream input transducer 112A, which are communicatively positioned so that they can measure flow by calculating the rate of sound wave propagation 114 from the upstream transducer 110A to the downstream transducer 112A. In one embodiment, the inclined angles 113A and 113B are approximately 35 degrees. As those of ordinary skill in the art will appreciate, each of the transducers may be positioned at any angle so long as they can all sense the flow of the fluid pathway 105. Additionally, each of the transducers need not be positioned at the same or complimentary angles and the transducer pairs need not be communicatively aligned as shown in FIG. 1. The transducers may be positioned anywhere near the pathway so long, as each can measure the flow of the fluid pathway 105.

FIG. 1 shows that an interventionless detection system 100 may also include the downhole activation device being detected, which in one exemplary embodiment may be a pump down plug 116. The pump down plug 116 may be detected by the downstream detector 107 after it is launched from the deployment port 108 and passes through the fluid pathway 105. In the illustrated embodiment, the interventionless detection system 100 may include additional detectors 118 for measuring other conditions inside of the system such as temperature, density, pressure, and pH.

Figure 2:
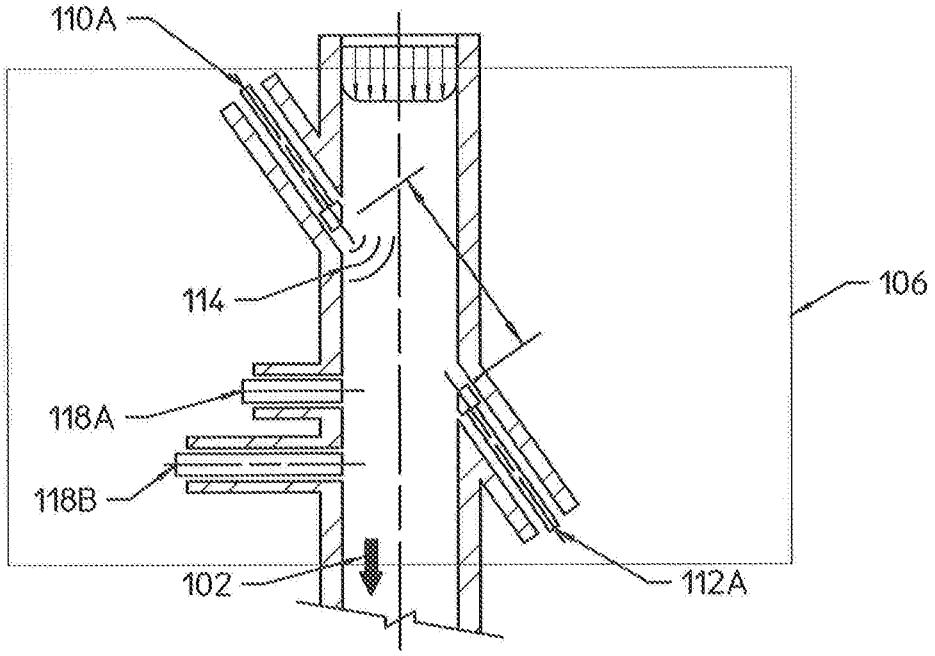
FIG. 2 is a cutaway view of the upstream ultrasonic detector of FIG. 1, in accordance with an embodiment of the present disclosure.

FIG. 2 illustrates a more detailed view of the first ultrasonic flow detector 106. The first ultrasonic flow detector 106 may include a transducer pair, transducer 110A and transducer 112A. Transducer 110A may be situated upstream from transducer 112A and each may be positioned at an inclined angle to measure the flow rate through the interventionless detection system 100. As those of ordinary skill in the art will appreciate, any of the characteristics of the first ultrasonic flow detector 106 described in FIG. 2 may also be shared with the second ultrasonic flow detector 107.

In one embodiment, transducer 110A may be calibrated to transmit ultrasonic wave forms and transducer 112A may be calibrated to receive the wave form. The base flow rate of an object entering and leaving the system may be derived by capturing sound wave propagation 114 between the transducer pair. In another embodiment, each of the transducers 110A and 112A may be calibrated to send and receive waveforms. The system may also include additional detectors 118 for measuring other properties of the system including temperature, density, pressure, and pH.

FIG. 2 illustrates one embodiment where the first flow detector 106 captures an unobstructed signal. Transducer 110A may transmit a sound wave 114 that propagates through the fluid flowing at an angle downstream to transducer 112A. The resulting signal establishes a control against which other signals from the same detector or additional detectors may be compared. As those of ordinary skill in the art will appreciate, an unobstructed signal may be used to calculate the rate of fluid flow through the system, a baseline flow measurement, and other properties of the system.

Figure 3:
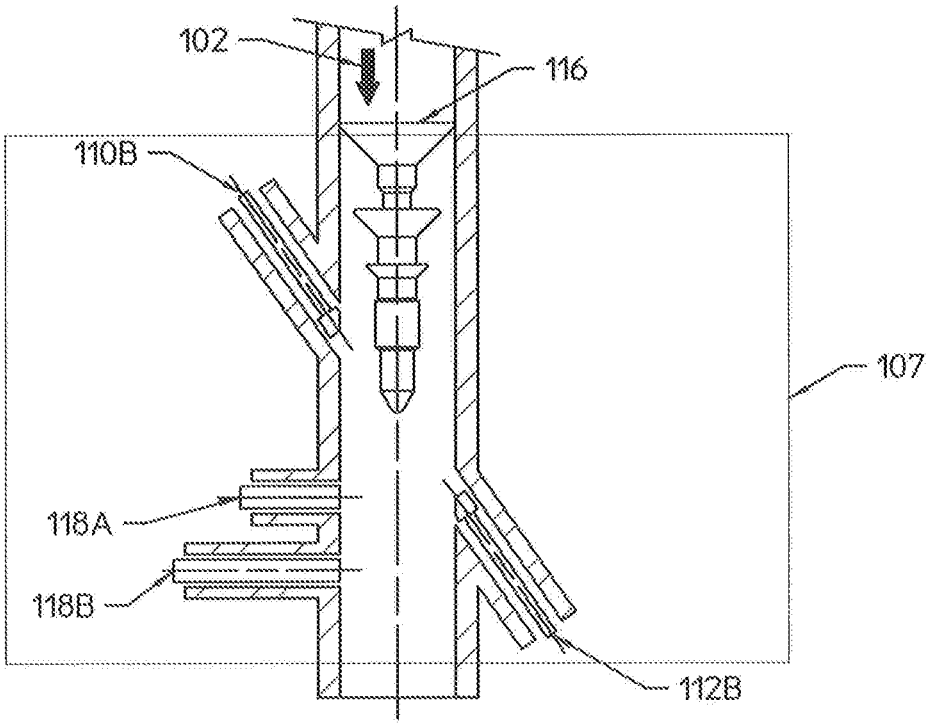
FIG. 3 is a cutaway view of the downstream ultrasonic detector of FIG. 1, detecting the presence of the downhole activation device, in accordance with an embodiment of the present disclosure.

A more detailed view of the second ultrasonic flow detector 107 is illustrated in FIG. 3. The second ultrasonic flow detector may include a transducer pair, transducer 110B and transducer 112B. Transducer 110B may be situated upstream from transducer 112B and each may be positioned at an inclined angle to measure the flow through the system. As shown in FIG. 3, a PDP 116 is blocking transducer 110B from transducer 112B, altering the signal detected by the transducers. The system may also include additional detectors 118 for measuring other properties of the system including temperature, density, pressure, and pH. As those of ordinary skill in the art will appreciate, any of the characteristics of the second ultrasonic flow detector 107 described in FIG. 3 may also be shared with the second ultrasonic flow detector 106.

A detailed description of the method for detecting a downhole activation device follows. In the interventionless detection system 100 described in FIGS. 1, 2, and 3, flow detectors 106 and 107 may be used to sense whether a downhole activation device has traveled the fluid pathway 105.

Figure 4:
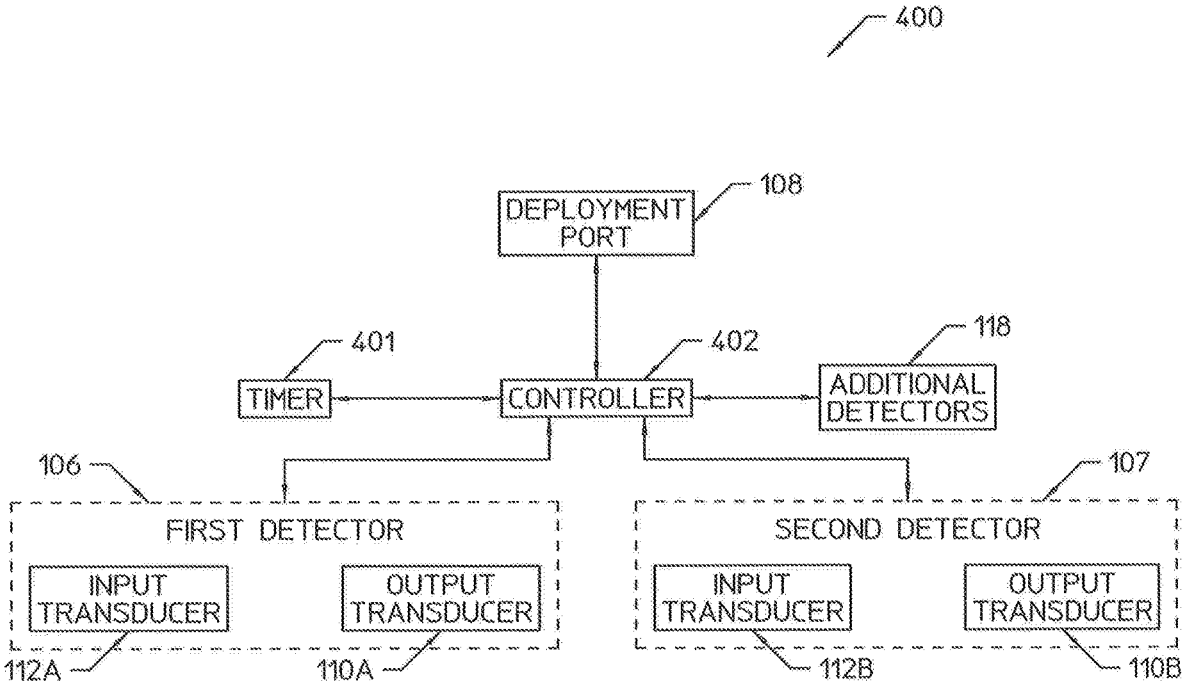
FIG. 4 is a block diagram of a controller coordinating the activities of the detectors and the deployment port.

FIG. 4 is a block diagram 400 of a controller 402 coordinating the activities of the first flow detector 106, the second flow detector 107, and the deployment port 108 using a timer 401. The controller 402 may include, among other things, one or more processing components, one or more memory components, one or more storage components, and one or more user interfaces.

In one embodiment, the controller 402 may be located downhole proximate to the flow detectors first flow detector 106, the second flow detector 107, the deployment port 108, and/or the timer 401. In other embodiments, these downhole components and any others may be equipped with a communication interface (e.g., electrical lines, fiber optic lines, telemetry system, etc.) that communicate data detected by downhole components to a surface level controller 402 in real time or near real time.

The controller 402 may be communicatively coupled to and send, receive, and display signals from the detectors 106 and 107, the deployment port 108, and the timer 401. The controller 402 may include an information handling system that sends one or more control signals to these components. It may also retrieve data from these downhole components and coordinate the control/communication signals associated with any coupled components. The control/communication signals may take whatever form (e.g., electrical) is necessary to communicate with the downhole components.

Control signals from the controller 402 may start and stop the timer 401, release an activation device from the deployment port 108, and signal the detectors 106 and 107 to transmit and receive signals. The controller 402 in FIG. 4 is configured to activate the timer 401, initiate the output transducers 110A and 110B, and prompt the deployment port 108 to launch a downhole activation device 116. The controller 402 may also coordinate control signals between the timer 401 and the first detector 106 when initiating a baseline measurement.

The controller 402 may read and display signals from the detectors 106 and 107 for the purposes or calculating a baseline measurement or detecting the presence of the downhole activation device 116. For example, the controller 402 may be coupled to read and display the input and output signals from the input transducers 110A and 110B and output transducers 112A and 112B from both detectors. It may read and display the timer's 401 start and stop times. It may communicate to an operator when maintenance is required according to the information from the coupled equipment.

The controller 402 may also communicate with other devices such as additional detectors 118 that may measure temperature, density, pressure, or pH. One of ordinary skill in the art can appreciate that the controller 402 may also serve to control other types of devices commonly employed during wellsite operations.

Figure 5:
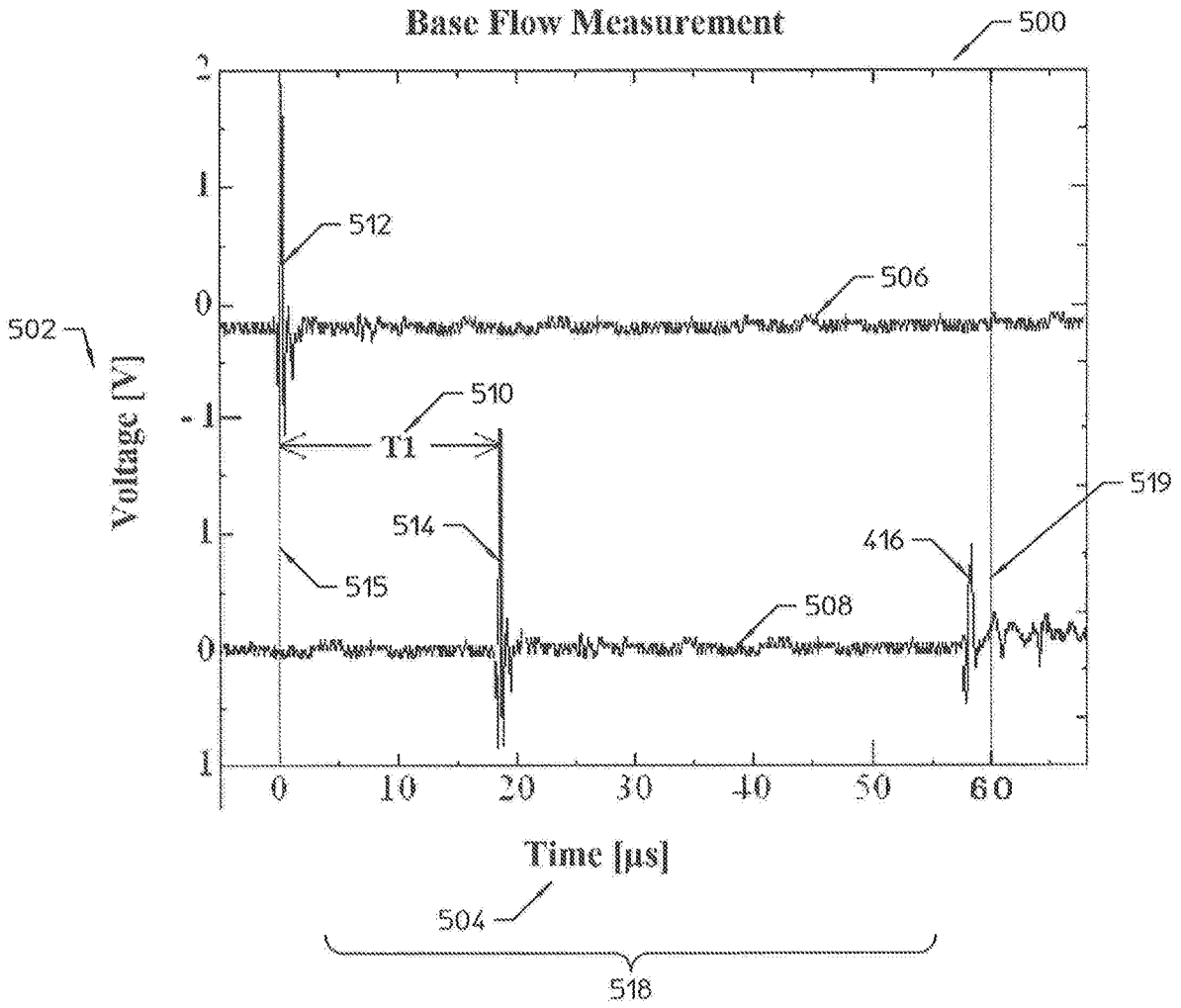
FIG. 5 is a plot of a baseline signal from a single detector illustrating an unobstructed signal, in accordance with an embodiment of the present disclosure.

FIG. 5 is a plot of a baseline flow measurement 500 from the first detector 106. The plot may also illustrate a baseline flow measurement captured from the second detector 407 and is representative of the information that may be read and displayed by a detection system structured like the block diagram in FIG. 4.

As shown, the plot illustrates voltage 502 measured by the first detector 106 as a function of time 504, A baseline measurement 500 may be accomplished by a number of different methods. One, exemplary method is to plot the transmitted voltage 506 from output transducer 110A and the corresponding voltage 508 measured by input transducer 112A and calculate the time difference T1 510 between the transmitted pulse wave 512 and received pulse wave 514. Transmission of the pulse wave 512 for a baseline flow measurement is initiated by a trigger event 515. In one embodiment, the trigger event may be a computer command. As those of ordinary skill in the art will appreciate, other devices for displaying or communicating signals from the detectors may be employed other than a plot. The signals could be a light or a sound or any other medium perceivable by the controller 402 or a wellsite operator, who can then determine the similarities or differences between the signals of the first detector 106 and the second detector 107.

The baseline flow measurement may be used to calculate the time it takes an object to pass through the detection system, the trigger duration event gate (TDEG) 518, which begins at the trigger event 515 and terminates at the trigger event end 519. The tinier 401 illustrated in FIG. 4 may establish the trigger events 515 and 519 and TDEG 518. The TDEG 518 may be used later to establish the window of time during which a downhole activation device should be detected after it is launched.

As those of ordinary skill in the art will appreciate, interventionless detectors that measure other properties of a fluid—e.g., temperature, pressure, density, etc.—in a pathway may be employed. The values from the detectors may be similarly plotted and a corresponding difference in a characteristic of the fluid may be derived for the purpose of determining the presence of a downhole activation device.

The detectors may also sense echo waves 516, which may be distinguished from pulse waves 512 and 514. As shown in the exemplary embodiment in FIG. 5, the echo wave 516 exhibits a different morphology on the plot compared to the pulse waves 512 and 514. The echo wave 516 is more attenuated and longer in duration than the pulse waves 512 and 514. Those of ordinary skill in the art will appreciate that other types of signals may be distinguishable based on the differences in the signal properties received by the controller 402.

Figure 6:
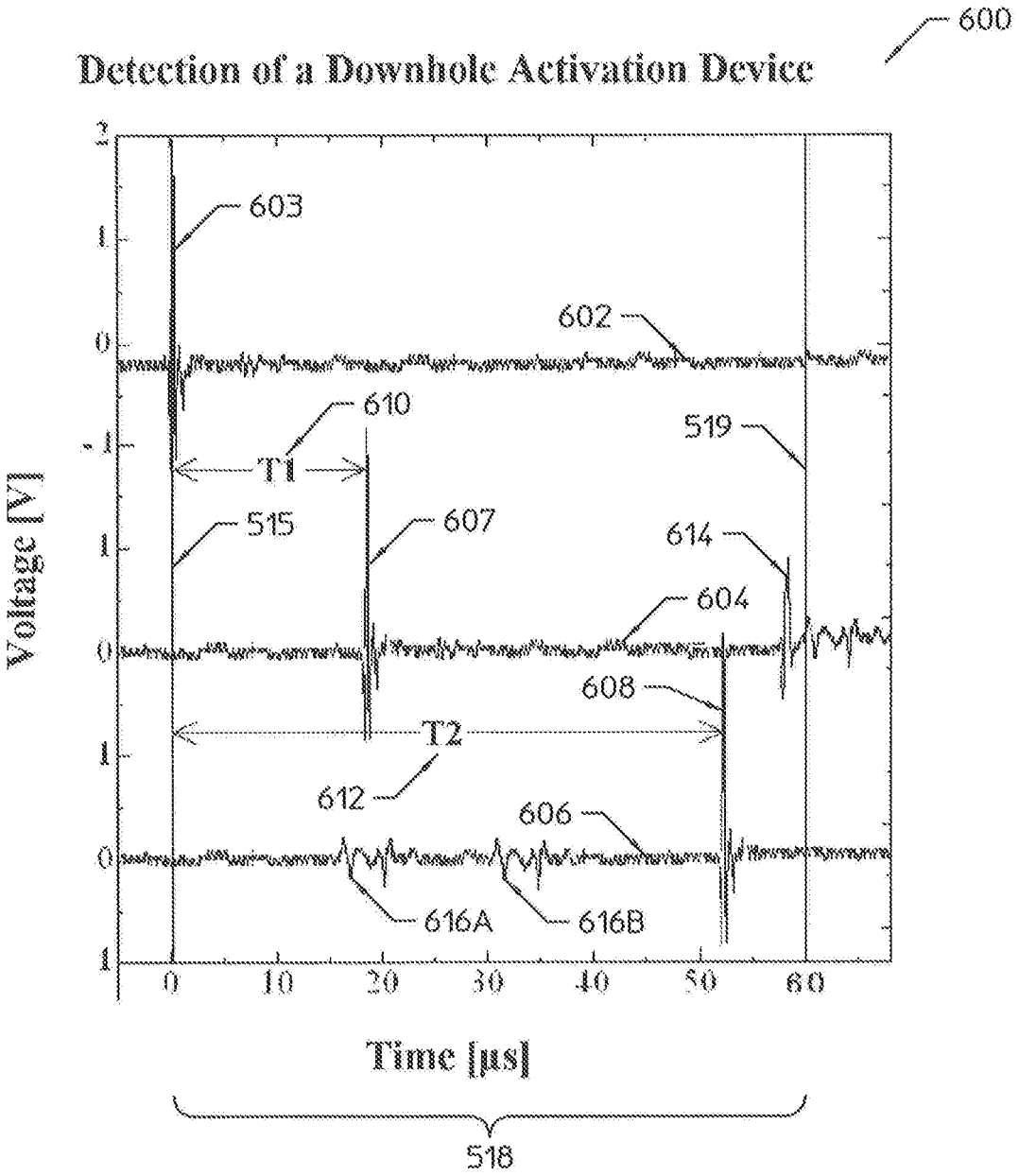
FIG. 6 is a plot of signals from an upstream detector and a downstream detector where the signals differ, indicating obstruction of the downstream detector by a downhole activation device, in accordance with an embodiment of the present disclosure.

FIG. 6 is a plot indicating detection of a downhole activation device 600. Determining the presence of a downhole activation device may be accomplished by a number of different methods. One illustrated embodiment is to combine the transmitted voltage 602 from both output transducers 110A and 110B. In this embodiment, both transducers simultaneously transmit the same pulse wave 603 (both pulse waves are represented as a single pulse wave 603 in the plot). The method may include plotting the received voltage from the first detector 604 and the received) voltage from the second detector 606, which includes the received pulse waves from both transducers, 607 and 608 respectively.

The time difference T1 610 between the pulse waves associated with the first detector 106 may then be calculated. In one illustrated embodiment, T1 610 matches the baseline flow measurement illustrated in FIG. 5. The time difference T2 612 between the pulse waves 607 and 608 associated with the second detector 107 may also be calculated.

Finally, the time differences T1 610 and T2 612 may be compared. In the illustrated embodiment, flow in and out of the system must be equal. Therefore, a comparison of T1 610 and T2 612 should be equal as well. If a PDP 116 is blocking the transmitted pulse wave 603 from the second detector 107 as illustrated in FIGS. 1 and 3 however, the received pulse wave 608 is delayed compared to the received pulse wave from the first detector 607, indicating that flow has increased, which is not possible. Thus, comparing T1 610 and T2 612 and determining they are different indicates that a PDP 116 is delaying the propagation of the sound wave as the PDP 116 blocks the second detector 107 and travels down the fluid pathway 105.

As in the illustrated embodiment of FIG. 6, the plot may also include echo waves 614, which may be distinguished from the pulse waves 603, 607, and 608. The exemplary embodiment in FIG. 6 further demonstrates that the detectors may distinguish other types of signals or noise 616. Like the echo wave 614, the other signals or noise 616 exhibit a different morphology or other characteristics when compared to the pulse waves 603, 607, and 608.

The detector plots may also include the trigger events 515 and 519 and associated TDEG 518 as calculated during the baseline measurement illustrated in FIG. 5. The TDEG 518 and the associated trigger event end 519 correspond with the window of time during which a downhole activation device should be detected after launch. Launching a downhole activation device may initiate the trigger event 515, which marks the beginning of the TDEG 518. Launching a downhole activation device may also start the timer 401 as illustrated in FIG. 4. If a delayed pulse wave 608 is registered within the TDEG 518 as in FIG. 6, then a downhole activation device is assured to have passed as expected.

Figure 7:
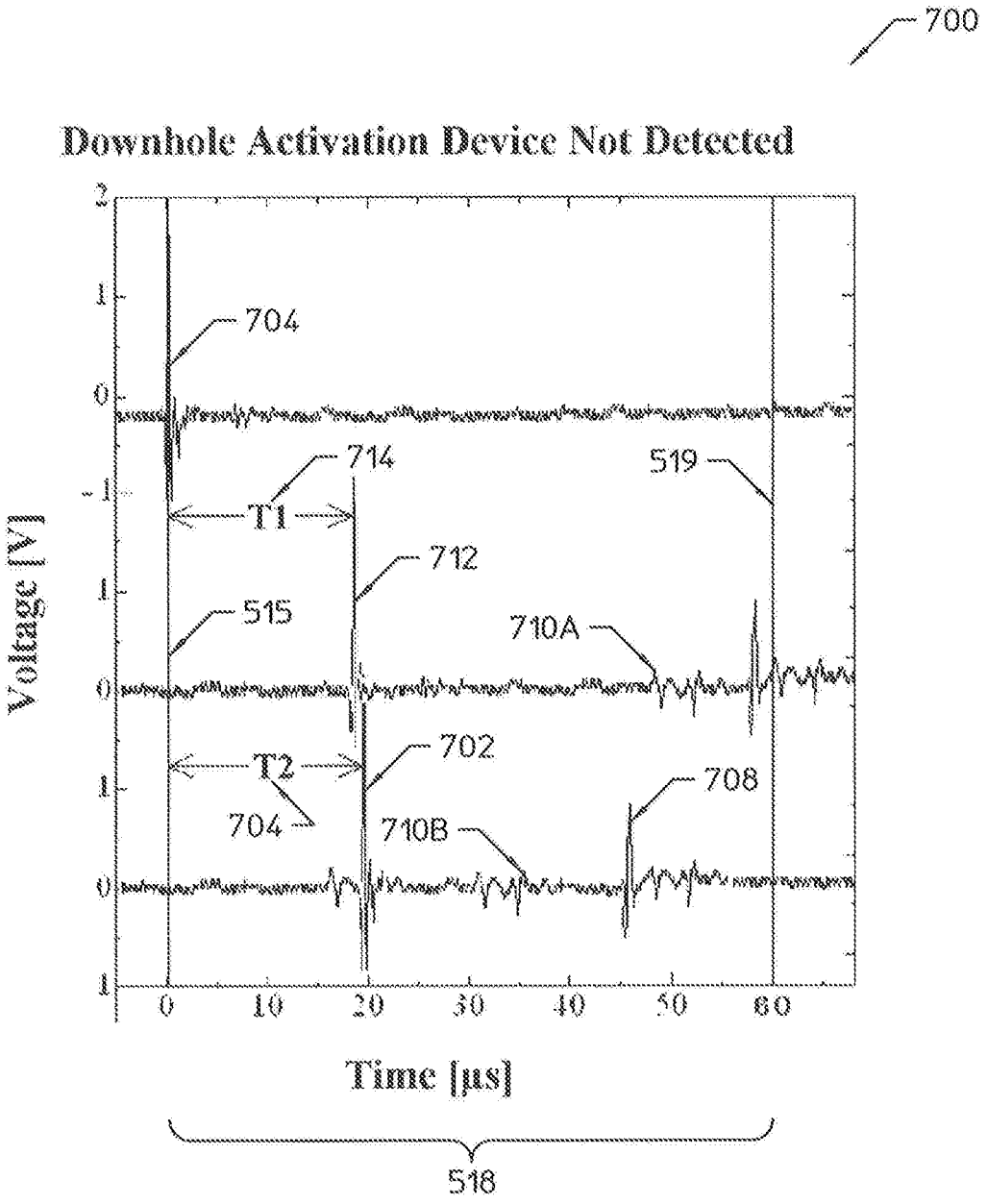
FIG. 7 is a plot of signals from an upstream detector and a downstream detector where the signals do not differ, indicating the absence of a downhole activation device, in accordance with an embodiment of the present disclosure.

FIG. 7 shows another plot illustrating how the detector signals may appear when a downhole activation device does not pass within the TDEG 518. It shares the same essential features as FIG. 6 except for the position of the received pulse wave on the second detector 702 and the corresponding time difference T2 704 from the transmitted pulse wave 706. FIG. 7 also displays an additional echo wave 708 and some additional signals or noise 710 distinguishable from the transmitted and received pulse waves 702, 706 and 712.

As in FIG. 6, a comparison of signals from the first detector and a second detector should be equal under the assumption that flow in and out of the system must be equal. And in this illustrated embodiment, the signals are equal, indicating that the flow rate is unchanged. The received pulse wave from the second detector 702 aligns with the received, pulse wave from the first detector 712 and as a result, T1 714 and T2 704 are the same. Compare this plot to FIG. 6 where the received pulse wave from the second detector 608 is delayed by an obstruction and T1 610 and T2 612 are unequal. The signals in FIG. 7 are equal because a PDP 116 or another type of downhole activation device has not delayed the transmitted wave form 702 from being reaching the second detector 107. If the signals are the same within the TDEG 518, then the PDP has not passed within the time expected after launch, which may indicate the PDP failed to launch or got caught somewhere within the system. The plot in FIG. 7 may also illustrate detector testing to check for proper calibration of the detectors.

Although the present disclosure and its advantages have been described in detail, it should be understood that various changes, substitutions and alterations can be made herein without departing from the spirit and scope of the disclosure as defined by the following claims. For example, as those of ordinary skill in the art will appreciate, although the detectors in connection with the present invention have been described in connection with use in a cement head, they can be used in connection with a variety of downhole systems mechanisms.

What is claimed is:

1. An interventionless system for detecting a downhole activation device launched downhole, comprising:
- a first detector generating a first signal;
- a second detector generating a second signal, the second detector located downhole from the first detector;
- wherein the presence of the downhole activation device is detected when the second signal differs from the first signal.

2. The system of claim 1 further comprising a deployment port located upstream from the second detector.

3. The system of claim 2, further comprising a controller connected to the first and second detectors and the deployment port.

4. The system of claim 1 further wherein the signals begin after launch of the downhole activation device.

5. The system of claim 1, herein the detectors comprise flow detectors.

6. The system of claim 1, wherein each detector comprises a pair of ultrasonic transducers.

7. The system of claim 6, wherein the fair of ultrasonic transducers are positioned at inclined angles.

8. The system of claim 6, wherein one of the transducers from the pair is located downstream from the other.

9. The system of claim 6, wherein the ultrasonic transducers are adapted to distinguish echo waves from the signals.

10. The system of claim 1, wherein the activation device comprises a device selected from the group consisting of a plug, a ball, and a dart.

11. The system of claim 1, further comprising a third detector that generates at least one more output signal.

12. The system of claim 11, wherein the third detector measures one or more of pressure, density, temperature, and pH.

13. A method of detecting a downhole activation device, comprising:
- launching the downhole activation device through a pathway;
- generating a first signal using a first detector;
- generating a second signal using a second detector located downhole from the first detector;
- comparing the signals from the first and second detectors;
- detecting the presence of the activation device downhole where the first and second signals are different from each other.

14. The method of claim 13 further comprising capturing a baseline signal using the first detector.

15. The method of claim 13, wherein launching the downhole activation device activates a timer.

16. The method of claim 13, wherein launching the downhole activation device initiates signal generation.

17. The method of claim 13, wherein, generating the signal for each detector comprises transmitting the signal;

receiving the signal; and calculating a differential with the transmitted and received signal.

18. The method of claim 13, wherein launching the downhole activation device initiates a Trigger Duration Event Gate (TDEG); wherein the TDEG indicates the length of time it takes for the downhole activation device to leave the pathway and is derived from a calculation using the first signal.

19. The method of claim 17, wherein comparing the signals comprises comparing the differentials from each detector.

20. The method of claim 19, wherein the first, and second signals are different from each other when the differentials not equal.

* * * * *